US008311710B2

(12) United States Patent
Budde et al.

(10) Patent No.: US 8,311,710 B2
(45) Date of Patent: Nov. 13, 2012

(54) LINKAGE CONTROL SYSTEM WITH POSITION ESTIMATOR BACKUP

(75) Inventors: Steven Conrad Budde, Dunlap, IL (US); Rajeev Kumar, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 13/370,229

(22) Filed: Feb. 9, 2012

(65) Prior Publication Data

US 2012/0143433 A1 Jun. 7, 2012

Related U.S. Application Data

(62) Division of application No. 12/232,968, filed on Sep. 26, 2008, now Pat. No. 8,135,518.

(60) Provisional application No. 60/960,441, filed on Sep. 28, 2007.

(51) Int. Cl.
*G06F 19/00* (2011.01)

(52) U.S. Cl. ..... 701/50

(58) Field of Classification Search ..... 701/50, 701/301; 37/411, 413; 172/2
See application file for complete search history.

(56) References Cited

U.S. PATENT DOCUMENTS 4,621,327 A * 11/1986 Dolph et al. ..... 701/43
4,635,960 A * 1/1987 Shirakuma ..... 280/124.102
4,700,303 A * 10/1987 Tokuyama et al. ..... 701/39
4,886,291 A * 12/1989 Okamoto ..... 280/5.501
5,065,326 A 11/1991 Sahm
5,446,980 A 9/1995 Rocke
5,490,081 A 2/1996 Kuromoto et al.
5,572,809 A 11/1996 Steenwyk et al.
5,735,066 A 4/1998 Tochizawa et al.
5,784,944 A 7/1998 Tozawa et al.
5,794,369 A 8/1998 Lee et al.
5,826,666 A 10/1998 Tozawa et al.
5,925,085 A 7/1999 Kleimenhagen et al.
5,951,613 A 9/1999 Sahm et al.
5,957,989 A 9/1999 Egawa et al.
5,995,895 A 11/1999 Watt et al.
6,032,093 A 2/2000 Denbraber et al.
6,064,918 A 5/2000 Ohtsukasa et al.
6,202,013 B1 3/2001 Anderson et al.
6,230,090 B1 5/2001 Takahashi et al.
6,233,511 B1 5/2001 Berger et al.
6,282,453 B1 8/2001 Lombardi
6,371,214 B1 4/2002 Anwar et al.
6,532,409 B1 3/2003 Fujishima et al.
6,819,993 B2 11/2004 Koch
6,845,334 B2 1/2005 Colburn
6,898,501 B2 * 5/2005 Schubert ..... 701/50
6,934,616 B2 8/2005 Colburn et al.

(Continued)

*Primary Examiner* — Bret Hayes
(74) *Attorney, Agent, or Firm* — Finnegan, Henderson, Farabow, Garrett & Dunner LLP

(57) ABSTRACT

A linkage control system for a machine having a linkage and a work implement is disclosed. The linkage control system has an operator input device configured to control the movement of the linkage, at least one actuator configured to respond to the operator input device to control the movement of the linkage, and at least one sensor configured to generate a signal indicative of sensor data on at least one actuator. The linkage control system has a controller in communication with at least one actuator, at least one sensor, and the operator input device. The controller is configured to calculate the position of the linkage, to detect anomalous sensor data from at least one sensor, and to predict the position of the linkage and work implement based on a last known accurate position, a last known accurate sensor data, and the operator input device.

20 Claims, 3 Drawing Sheets

U.S. PATENT DOCUMENTS

| | | | | |
|---|---|---|---|---|
| 6,954,150 | B2 | 10/2005 | Nishimura et al. | |
| 6,968,264 | B2 | 11/2005 | Cripps | |
| 7,079,931 | B2 | 7/2006 | Sahm et al. | |
| 7,114,430 | B2 | 10/2006 | Reedy et al. | |
| 7,139,651 | B2 | 11/2006 | Knowlton et al. | |
| 7,222,444 | B2 | 5/2007 | Hendron et al. | |
| 7,266,477 | B2 | 9/2007 | Foessel | |
| 7,603,218 | B2 * | 10/2009 | Fackler et al. | 701/50 |
| 8,135,518 | B2 * | 3/2012 | Budde et al. | 701/50 |
| 2004/0267404 | A1 * | 12/2004 | Danko | 700/245 |
| 2006/0041361 | A1 | 2/2006 | Matrosov | |
| 2006/0263189 | A1 | 11/2006 | Vigholm | |
| 2007/0168100 | A1 | 7/2007 | Danko | |
| 2008/0097672 | A1 | 4/2008 | Clark et al. | |
| 2008/0097693 | A1 | 4/2008 | McCain | |
| 2008/0142232 | A1 | 6/2008 | Palmer et al. | |
| 2008/0199294 | A1 | 8/2008 | Sahlin et al. | |
| 2011/0004379 | A1 | 1/2011 | Murota | |

* cited by examiner

LINKAGE CONTROL SYSTEM WITH POSITION ESTIMATOR BACKUP

This application is a divisional of U.S. application Ser. No. 12/232,968, filed Sep. 26, 2008 now U.S. Pat. No. 8,135,518, which is based on and claims the benefit of priority from U.S. Provisional Application No. 60/960,441, filed Sep. 28, 2007, both of which are expressly incorporated herein by reference.

TECHNICAL FIELD

The present disclosure is directed to a linkage control system, and more particularly, to a linkage control system having a position estimator for known error zones.

BACKGROUND

Machines often use linkages to support work implements for digging, lifting, clearing, or smoothing. Examples of these machines include excavators, loaders, dozers, motor graders, and other types of heavy machinery. These linkages are typically controlled by an operator input device, and often include monitoring of the position of the linkage and the work implement. These machines can be controlled by an operator in the machine, controlled remotely by an operator, or controlled through automation.

For example, an operator input device such as a joystick, a pedal, or any other suitable operator input device may be movable to generate a signal indicative of a desired velocity of an associated linkage and work implement. When an operator moves the operator input device, the operator expects the linkage and work implement to move through its free range of motions. However, in some implementations, the free range of motion is not available. The free range of motion is not available because of the risk of colliding with other parts of the machine or other linkages, or zones of movement where position data is unreliable. Attempts to avoid these risks by restricting the range of movement of the linkage and work implement often result in the operator losing more than the minimum range of motion necessary to avoid these risks.

One method of improving the utilization of the range of motion of a linkage while avoiding collisions with other linkages is described in U.S. Pat. No. 6,819,993 (the '993 patent) issued to Koch on Nov. 16, 2004. The '993 patent describes a system and method for estimating the position of a mechanical linkage of a machine. The estimated position of a mechanical linkage is set to an initial position. The estimated position of the mechanical linkage is updated based upon the movements of the mechanical linkage. A determination is made when the estimated position of the mechanical linkage substantially corresponds to an actual position of the mechanical linkage. The estimated position zone of the mechanical linkage is used to prevent collisions with other mechanical linkages.

Although the system of the '993 patent may reduce collisions and damages to, and between, linkages, the system of the '993 patent does not allow movement of other linkages through zones where the position data is unreliable. For example, a soft fault of the wiring harness may make the position data unreliable, and the system of the '993 patent does not allow the mechanical linkages to be operated safely when both their positions cannot be determined or estimated.

The disclosed linkage control system is directed to overcoming one or more of the problems set forth above.

SUMMARY OF THE INVENTION

In one exemplary aspect, the present disclosure is directed to a linkage control system for a machine having a linkage and a work implement. The linkage control system may include an operator input device configured to control the movement of the linkage, at least one actuator configured to respond to the operator input device to control the movement of the linkage, and at least one sensor configured to generate a signal indicative of sensor data on at least one actuator. The linkage control system may also include a controller in communication with at least one actuator, at least one sensor, and the operator input device. The controller may be configured to calculate the position of the linkage, to detect anomalous sensor data from at least one sensor, and to predict the position of the linkage and work implement based on a last known accurate position, last known accurate sensor data, and the operator input device.

In another aspect, the present disclosure is directed to a method of operating a machine having a linkage and a work implement. The method may include tracking the position of the linkage and the work implement and monitoring the sensor data for anomalous sensor data. Upon detection of anomalous sensor data, the method may also include entering a predictive mode to predict the position of the linkage and work implement based on a last known accurate position, the last known accurate sensor data, and an operator input device. The method may further include detecting when the sensor data is accurate, and calculating a position of the linkage and work implement based on the sensor data.

DETAILED DESCRIPTION

Figure 1:
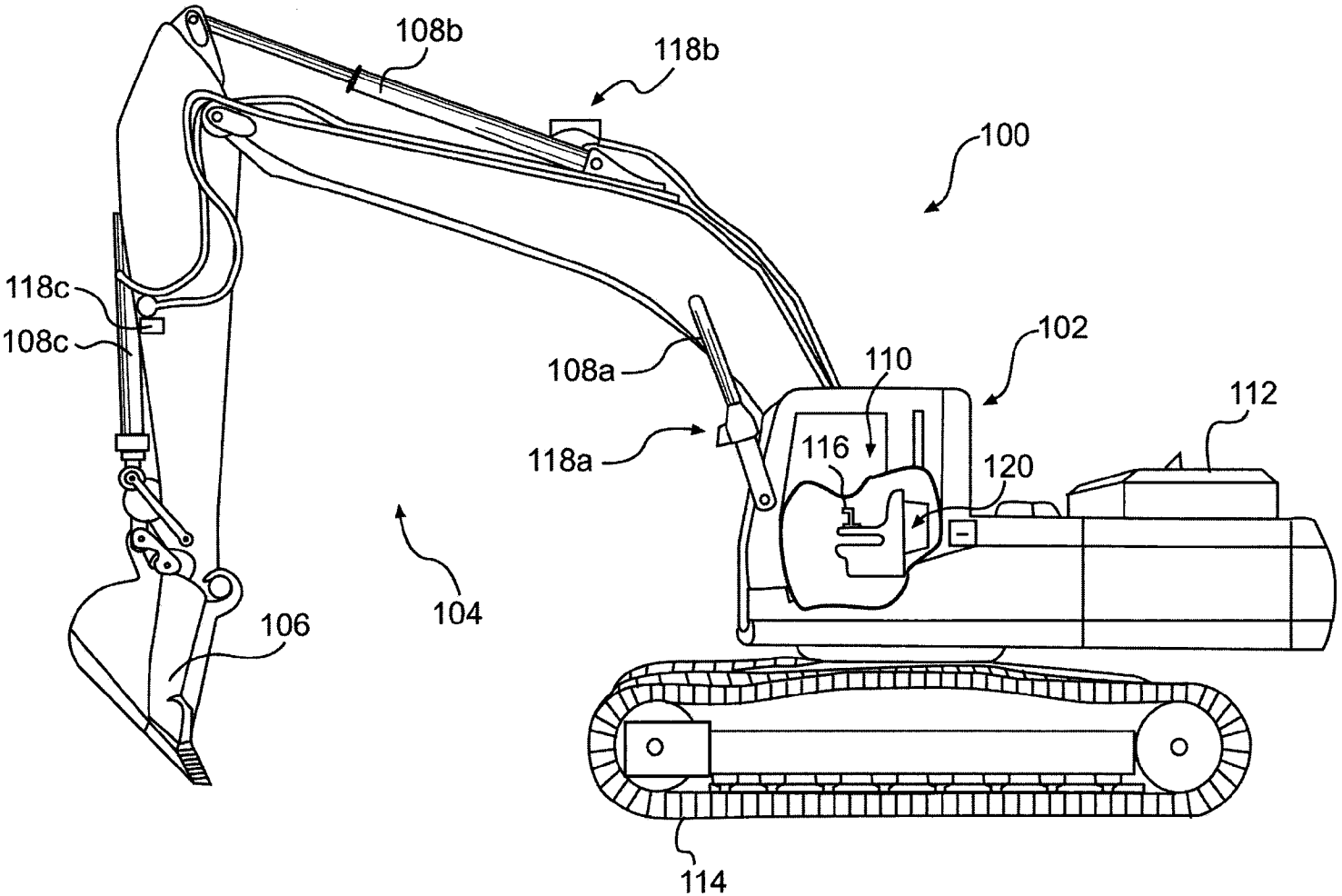
FIG. 1 is a side-view diagrammatic illustration of an exemplary disclosed machine.

FIG. 1 illustrates an exemplary machine 100. Machine 100 may be a fixed or mobile machine that performs some type of operation associated with an industry such as, for example, mining, construction, farming, transportation, or any other industry known in the art. For example, machine 100 may be an earth moving machine such as an excavator, a dozer, a loader, a backhoe, a motor grader, or any other earth moving machine. In one exemplary embodiment, machine 100 may include a frame 102, a linkage 104, a work implement 106, one or more actuators 108*a-c*, an operator interface 110, a power source 112, and at least one traction device 114.

Frame 102 may include any structural unit that supports movement of machine 100. Frame 102 may embody, for example, a stationary base connecting power source 112 to traction device 114, a movable element of a linkage 104, or any other frame 102 known in the art. Linkage 104 may be connected to frame 102 and work implement 106. Linkage 104 and work implement 106 may have actuators 108*a-c* to move linkage 104 and work implement 106 into new positions to perform tasks.

Different work implements 106 may be attachable to a single machine 100 and controllable via operator interface 110. Work implement 106 may include any device used to perform a particular task such as, for example, a bucket, a fork arrangement, a blade, a shovel, a ripper, a dump bed, a broom, a snow blower, a propelling device, a cutting device, a grasping device, or any other task-performing device known in the art. Work implement 106 may be connected to machine 100 via a linkage 104. Linkage 104 may include various configurations and components, such as, for example, a direct pivot mechanism, a boom and stick, articulated members, one or more cylinders, a motor, or any other appropriate configurations or components known in the art. Work implement 106 may be configured to pivot, rotate, slide, swing, lift, or move relative to machine 100 in any manner known in the art.

Operator interface 110 may be configured to receive input from an operator indicative of a desired work implement 106 movement. In one exemplary embodiment, operator interface 110 may include an operator input device 116 embodied in a multi-axis joystick located to one side of an operator station. Operator input device 116 may be a proportional-type control device configured to position and/or orient work implement 106 and to produce an operator input device 116 position signal indicative of a desired velocity or movement of work implement 106. It is contemplated that additional and/or different operator input devices 116 may be included within operator interface 110 such as, for example, wheels, knobs, push-pull devices, switches, pedals, and other operator input devices known in the art. Alternatively, in other exemplary embodiments, operator interface 110 and operator input device 116 may be at a remote location, or may be absorbed into an automated control system for machine 100.

Power source 112 may be an engine such as, for example, a diesel engine, a gasoline engine, a natural gas engine, or any other engine known in the art. It is contemplated that power source 112 may alternately be another source of power such as a fuel cell, a power storage device, an electric or hydraulic motor, or other power sources known in the art. In one exemplary embodiment, power source 112 may create a power output. The power output may be used to provide power to machine 100.

In one exemplary embodiment, traction device 114 may include tracks located on each side of machine 100 (only one side shown). In an alternative exemplary embodiment, traction device 114 may include wheels, belts, or other traction devices. Traction device 114 may or may not be steerable. It is contemplated that traction device 114 may be hydraulically controlled, mechanically controlled, electronically controlled, or controlled in any other manner known in the art.

Actuators 108*a-c* may be hydraulically actuated, mechanically actuated, pneumatically actuated, or actuated in any other suitable manner known in the art. In one exemplary embodiment, actuators 108*a-c* may have one or more attached sensors 118*a-c*. Each sensor 118*a-c* may generate a signal indicative of one or more parameters of an actuator 108*a-c*, a linkage 104, and/or work implement 106. Sensor data from sensors 118*a-c* may include letters, numbers, symbols, pulses, voltage levels, or other configurations known in the art that may represent a specific parameter from sensors 118*a-c*. In one exemplary embodiment, sensors 118*a-c* may monitor the fluid pressure, pressure differential, extension of a cylinder, or other parameters known in the art for monitoring actuators 108*a-c*. In an alternative exemplary embodiment, sensors 118*a-c* may be a Global Positioning System (GPS) receiver, or a similar system, measuring the location of a particular element of a linkage 104 or of work implement 106. In a further exemplary embodiment, sensors 118*a-c* may measure other parameters, such as the angle between two elements of linkages 104, a linkage 104 and of work implement 106, etc. In another exemplary embodiment, sensors 118*a-c* may be a package of sensors deployed along a linkage 104, work implement 106, and/or actuators 108*a-c*. In still another exemplary embodiment, sensors 118*a-c* may include accelerometers and rate gyroscopes. The accelerometers may measure acceleration along the horizontal plane of each element of linkage 104 and of work implement 106. The rate gyroscopes may measure the angular rate of rotation of one or more elements of linkage 104 and of work implement 106.

Figure 2:
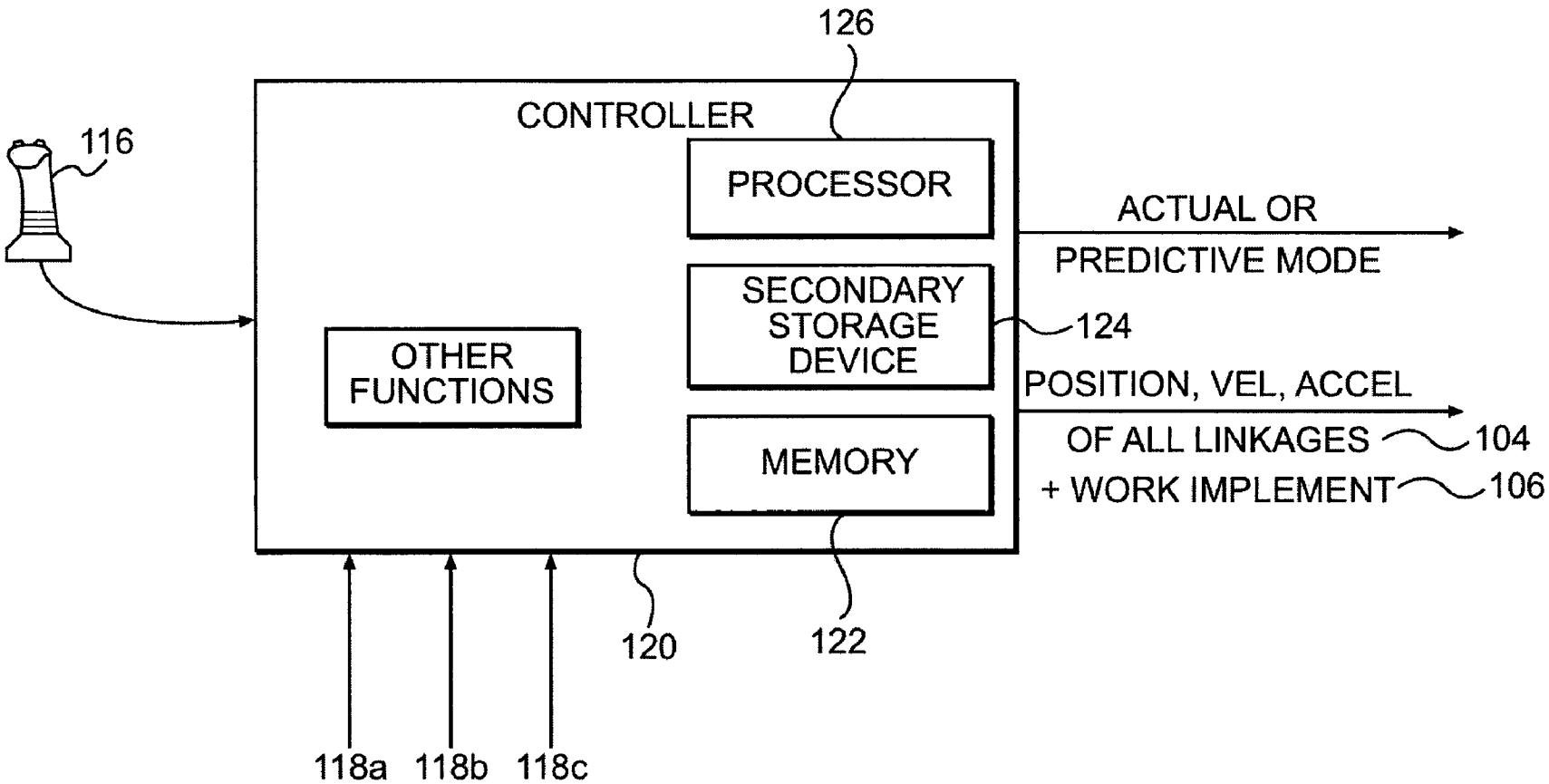
FIG. 2 is a schematic illustration of an exemplary disclosed controller for the machine of FIG. 1.

As illustrated in FIG. 2, machine 100 may include a controller 120. In one exemplary embodiment, controller 120 may be in communication with operator input device 116 and sensors 118*a-c*. In one exemplary embodiment, controller 120 may output one or more of the position, velocity, and acceleration of elements of linkage 104 and of work implement 106. In a further exemplary embodiment, controller 120 may also output status on predictive or actual mode.

In an exemplary embodiment, controller 120 may embody a single microprocessor or multiple microprocessors. Numerous commercially available microprocessors may be configured to perform the functions of controller 120. It should be appreciated that controller 120 may readily be embodied in a general microprocessor capable of controlling numerous machine 100 functions. In one exemplary embodiment, controller 120 may include a memory 122, a secondary storage device 124, a processor 126, and may include any other suitable components known in the art for running an application. In another exemplary embodiment, various other circuits may be associated with controller 120, such as power supply circuitry, signal conditioning circuitry, solenoid driver circuitry, and other types of circuitry known in the art.

In one exemplary embodiment, memory 122 may contain separate tables or one or more equations. The tables and equations may relate to the relationships between sensor data and the position, velocity, and acceleration of actuators 108*a-c*, linkage 104, and/or work implement 106. In an exemplary embodiment, tables and equations may be specific to exact configurations of actuators 108*a-c*, linkage 104, and/or work implement 106. In another exemplary embodiment, controller 120 may be configured to allow the operator to directly modify the tables or equations via a manual input device and/or to select specific tables and equations from available relationships stored in memory 122 or secondary storage device 124 of controller 120 to model the actuation of actuators 108*a-c* or relationships between actuators 108*a-c*, linkage 104, and/or work implement 106. It is contemplated that the tables or equations may be selectable for various applications in which machine 100 is used, such as, for example, tables or equations optimized for digging, tables or equations for leveling, tables or equations for pipe-laying, and other such machine applications. The relationship tables or equations may alternately be automatically selected and/or modified by controller 120 in response to recognizing the type and number of signals from sensors 118*a-c*.

Figure 3:
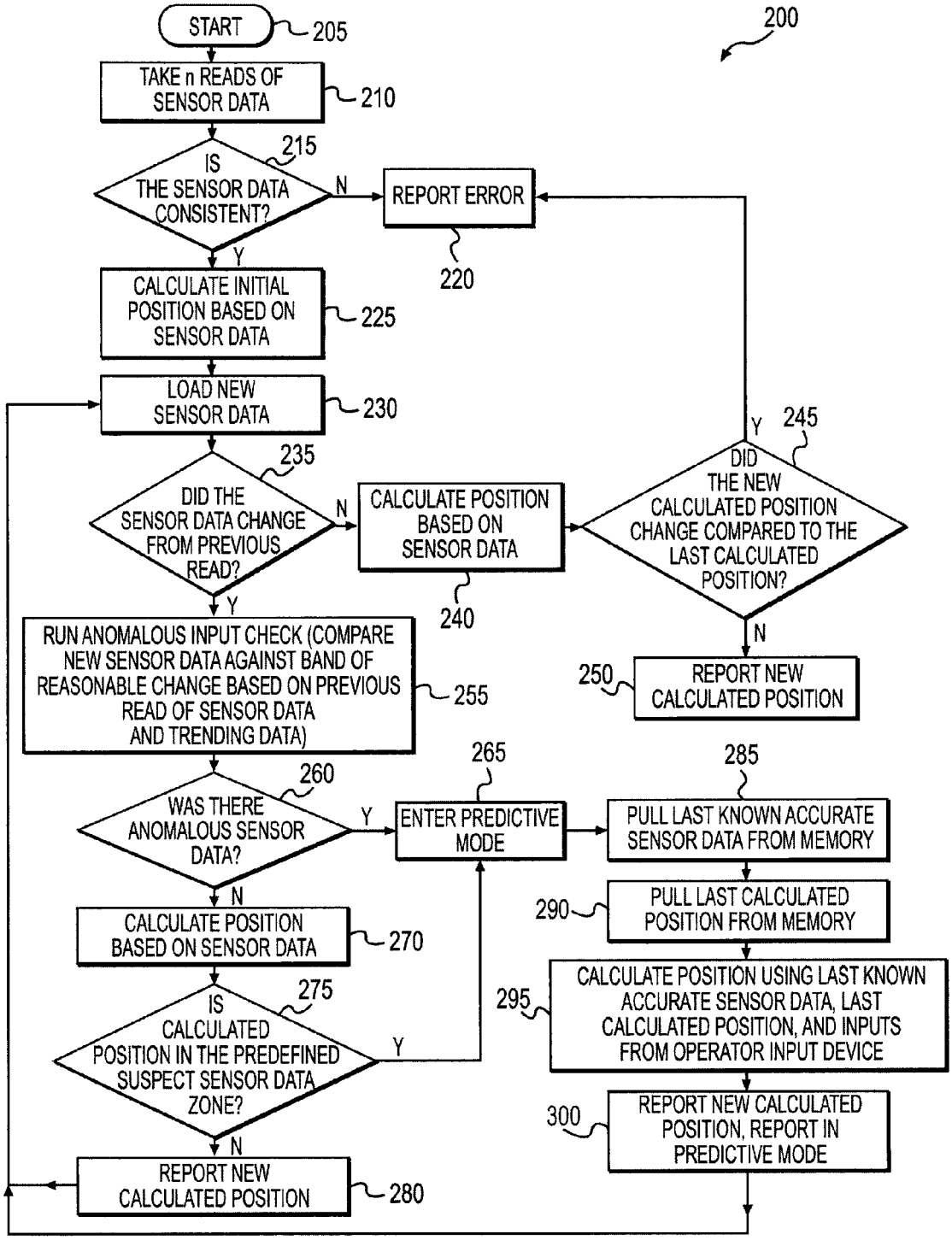
FIG. 3 is a flow chart showing a method for determining the position, velocity, and acceleration of the linkages and work implement of a machine using the controller in FIG. 2, in accordance with an exemplary embodiment of the disclosed machine.

FIG. 3 is a flow chart showing an exemplary method 200 for determining the position, velocity, and acceleration of linkage 104 and work implement 106. Method 200 may be implemented in controller 120. In one exemplary embodiment, method 200 may determine the positions of linkage 104 and work implement 106. In an alternate exemplary embodiment, method 200 may also determine the velocity and/or acceleration of linkage 104 and work implement 106. In a further exemplary embodiment, method 200 may report if the position, and other values, are based on actual sensor data, or determined using predictive mode.

Method 200 starts at start block 205. In one exemplary embodiment, method 200 may be started when controller 120 is powered up. Controller 120 may be powered up at the start of machine 100 or at some later point. In an alternative embodiment, method 200 is started the first time a command is sent by operator input device 116 to linkage 104 or work implement 106.

At step 210, controller 120 may take "n" reads of sensor data. The value "n" may be about 5 times, or in alternate embodiments may be more or less than 5 times. The data may be stored in memory 122, or some other means known in the art to preserve data for later use.

At step 215 controller 120 may compare the "n" records of sensor data for consistency. In one exemplary embodiment, step 215 may require all the sensor data for each parameter to be consistent within some percentage of the value of one of the sensor data points for a given parameter. In an alternate exemplary embodiment, the allowed variance between reads of the same sensor point may be a fixed value. In another exemplary embodiment, an allowed variance may be based on the magnitude of each sensor data point. In one exemplary embodiment, the medium of the sensor data may be the value the consistency of the sensor data is compared against. In another exemplary embodiment, the mean of the sensor data may be the value the consistency of the sensor data is compared against. In further exemplary embodiments, the first value for a given sensor data point may be the value the consistency of the sensor data is compared against, or any of the "n" values may be selected.

In an alternative exemplary embodiment, machine 100 has a safe position for linkage 104 and work implement 106 that machine 100 returns to on shutdown, or can be automatically sent to on start-up. The "n" reads of sensor data can be compared to the safe position to determine consistency, using one of the methods to determine consistency of step 215.

The sensor data may be inconsistent if one or more values for any given parameter are outside the variance. In one exemplary embodiment, one value on one parameter may result in a finding of inconsistency. In other exemplary embodiments, 2 values on the same parameter may be out of variance to find inconsistency, or one value on at least two parameters may be out of variance to find inconsistency.

If the "n" records of sensor data are inconsistent, in step 220, an error report may be generated and outputted by controller 120. In one exemplary embodiment, the error report may be displayed to the operator, and in other alternative exemplary embodiments, the error report may be sent to other parts of controller 120 or other processors.

In step 225, if the "n" records of sensor data are consistent, controller 120 may calculate the initial position based on sensor data. The initial position velocity and acceleration may be zero, since linkage 104 and work implement 106 may be stationary. In one exemplary embodiment, the sensor data may provide the position, velocity, and acceleration of linkage 104 and work implement 106. Controller 120 then may calculate or report the position of linkage 104 and work implement 106. In an alternate exemplary embodiment, the velocity and acceleration may be calculated from hydraulic pressure in actuator 108*a-c* cylinders, rate of change of pressure or extension of actuator 108*a-c* cylinders, or other measurements known in the art that may allow the calculation of velocity and acceleration of linkage 104 and work implement 106. In an alternate exemplary embodiment, linkage 104 and work implement 106 may start out in a known safe position, and the velocity and acceleration may be reported by, or calculated from, sensor data, and the velocity and acceleration may be used to calculate the new position of linkage 104 and work implement 106. In addition, in another exemplary embodiment, sensor data may include angles between elements of linkage 104 and/or work implement 106, which may be used to confirm the calculated position, or the difference between successive angles, and the rate of change, may be used to calculate the velocity and acceleration between linkage 104 and work implement 106. In an alternate exemplary embodiment, linkage 104 and work implement 106 may have GPS type receivers, and the sensor data may include the positional data generated by the GPS type receivers, which may be used to calculate the position, velocity, and acceleration, or may be used to confirm or refine calculations performed by controller 120. In an exemplary embodiment, a GPS type receiver may be used as a reference when installed on machine 100 stationary to the frame of reference of machine 100. In one exemplary embodiment, the reference GPS receiver may be installed next to controller 120, and in another exemplary embodiment, the reference GPS receiver may be anywhere on frame 102 that is stationary relative to the body of machine 100.

At step 230, controller 120 may load new sensor data from sensors 118*a-c*. The sensor data may be stored to memory 122, or some other means known in the art to preserve data for later use.

At step 235, controller 120 may compare the previous records of sensor data to the new inputs of sensor data from step 230 for consistency. In one exemplary embodiment, step 235 may require all the sensor data for each parameter to be consistent within some percentage of the value of one of the sensor data points for a given parameter. In an alternate exemplary embodiment, the allowed variance between reads of the same sensor data point may be a fixed value. In another exemplary embodiment, an allowed variance may be based on the magnitude of each sensor data point. In one exemplary embodiment, the medium of the sensor data may be the value the consistency of the sensor data point is compared against. In another exemplary embodiment, the mean of the sensor data points may be the value the consistency of the sensor data is compared against.

In step 240, if the previous records of sensor data are consistent with the current sensor data, controller 120 may calculate the position based on sensor data. The velocity and acceleration may be zero because linkage 104 and work implement 106 have not been commanded to move yet and are supposed to be stationary. In one exemplary embodiment, the sensor data may provide the position, velocity, and acceleration of linkage 104 and work implement 106. Controller 120 may then calculate or report the position of linkage 104 and work implement 106. In an alternate exemplary embodiment, the velocity and acceleration may be calculated from hydraulic pressure in actuator 108*a-c* cylinders, rate of change of pressure or extension of actuator 108*a-c* cylinders, or other measurements known in the art that may allow the calculation of velocity and acceleration of linkage 104 and work implement 106. In an alternate exemplary embodiment, linkage 104 and work implement 106 may start out in a known safe position, and the velocity and acceleration may be reported by, or calculated from, sensor data, and the velocity and acceleration may be used to calculate the new position of linkage 104 and work implement 106. In addition, in another exemplary embodiment, sensor data may include angles between elements of linkage 104 and/or work implement 106, which may be used to confirm the calculated position, or the difference between successive angles, and the rate of change, may be used to calculate the velocity and acceleration between linkage 104 and work implement 106. In an alternate exemplary embodiment, linkage 104 and work implement 106 may have GPS type receivers, and the sensor data may include the positional data generated by the GPS type receivers, which may be used to calculate the position, velocity, and acceleration, or may be used to confirm or refine calculations performed by controller 120. In an exemplary embodiment, a GPS type receiver may be used as a reference when installed on machine 100 stationary to the frame of reference of machine 100. In one exemplary embodiment, the reference GPS receiver may be installed next to controller 120, and in another exemplary embodiment, the reference GPS receiver may be anywhere on frame 102 that is stationary relative to the body of machine 100.

At step 245, controller 120 may compare previously calculated position, velocity and acceleration to the new calculated position, velocity and acceleration from step 240 for consistency. In one exemplary embodiment, step 245 may require all the values to be consistent within some percentage of the value of one of the calculated or previously calculated values, i.e. position, velocity, and acceleration. In an alternate exemplary embodiment, the allowed variance may be a fixed value of each calculated or previously calculated value. In another exemplary embodiment, an allowed variance may be based on the magnitude of each calculated or previously calculated value. In one alternate exemplary embodiment, the differences in sensor data may be used to predict the expected changes in calculated position, velocity and acceleration, and compared to the actually calculated position, velocity and acceleration, as an additional check on consistency. In one exemplary embodiment, the medium of the calculated and previously calculated values may be the value the consistency of the calculated values are compared against. In another exemplary embodiment, the mean of the calculated and previously calculated values may be the value the consistency of the calculated values are compared against. In another exemplary embodiment, the previously calculated values may be the value the consistency of the calculated values are compared against.

In step 250, if the position, velocity and acceleration are consistent, a report may be generated and outputted by controller 120. In one exemplary embodiment, the report may be displayed to the operator, and in other alternative exemplary embodiments, the report may be sent to other parts of controller 120 or other processors. In further exemplary embodiments, the report may also be stored in memory 122 or some other means known in the art to preserve data for later use.

If the position, velocity and acceleration in step 245 are found to be inconsistent, in step 220 an error report may be generated and outputted by controller 120. In one exemplary embodiment, the error report may be displayed to the operator, and in other alternative exemplary embodiments, the error report may be sent to other parts of controller 120 or other processors.

At step 255, controller 120 may run the anomalous input check. Controller 120 may compare previously inputted sensor data to sensor data received in step 230. The anomalous input check may predict a band of reasonable change based on previous reads of sensor data and trending data. In one exemplary embodiment, the trending data may be based on previous position, velocity, acceleration, time between reads, and input from operator input device 116. In another exemplary embodiment, the band of reasonable change may be determined by requiring all the values for a parameter to be consistent within some percentage of the value of one of the sensor data points for a given parameter. In another alternate exemplary embodiment, the allowed band of reasonable change may be a fixed value. In still another exemplary embodiment, an allowed band of reasonable change may be based on the magnitude of each sensor data point. In a further exemplary embodiment, an allowed band of reasonable change may be determined based on the sensor data, the calculated position and the associated velocity, or velocity and the associated acceleration.

At step 260, controller 120 may determine if the anomalous input check found anomalous sensor data in the sensor data of step 230.

If anomalous sensor data was found in step 260, or if the calculated position in step 275 is in a predefined suspect sensor data zone, then in step 265, controller 120 may enter a predictive mode.

In step 270, if no anomalous sensor data was found in step 260, controller 120 may calculate the position based on sensor data. In one exemplary embodiment, the sensor data may provide the position, velocity, and acceleration of linkage 104 and work implement 106. In an alternate exemplary embodiment, the velocity and acceleration may be calculated from hydraulic pressure in actuator 108*a-c* cylinders, rate of change of pressure or extension of actuator 108*a-c* cylinders, or other measurements known in the art that may allow the calculation of velocity and acceleration of linkage 104 and work implement 106. In addition, sensor data may include angles between elements of linkage 104 and/or work implement 106, which may be used to confirm the calculated position. In another exemplary embodiment, the difference between successive angles, and the rate of change, may be used to calculate the velocity and acceleration between linkage 104 and work implement 106. In an alternate exemplary embodiment, linkage 104 and work implement 106 may have GPS type receivers, and the sensor data may include the positional data generated by the GPS type receivers, which may be used to calculate the position, velocity, and acceleration, or may be used to confirm or refine calculations performed by controller 120. In an exemplary embodiment, a GPS type receiver may be used as a reference when installed on machine 100 stationary to the frame of reference of machine 100. In one exemplary embodiment, the reference GPS receiver may be installed next to controller 120, and in another exemplary embodiment, the reference GPS receiver may be anywhere on frame 102 that is stationary relative to the body of machine 100. In most exemplary embodiments, the position, velocity, and acceleration of linkage 104 and work implement 106 may be stored in memory 122, registers, or some other means known in the art to preserve data for later use.

In step 275, controller 120 may determine if the position calculated in step 270 is in the predefined suspect sensor data zone. In an alternate exemplary embodiment, there may be more then one predefined suspect sensor data zone. In an alternate exemplary embodiment, controller 120 may compare the position calculated in step 270 with a table of position values. In a further alternate exemplary embodiment, an error range may be assigned to the calculated position, and if the error range overlaps the predefined suspect sensor data zone, the calculated position may be determined to have entered the predefined suspect sensor data zone.

In step 280, if the position in step 275 was found not to be in the predefined suspect sensor data zone, position, velocity and acceleration may be reported by controller 120. In addition, in an exemplary embodiment, controller 120 may report it was in actual mode. In one exemplary embodiment, the report may be displayed to the operator, and in other alternative exemplary embodiments, the report may be sent to other parts of controller 120 or other processors. In further exemplary embodiments, the report may also be stored in memory 122, registers, or some other means known in the art to preserve data for later use. After step 280 is completed, controller 120 may next execute step 230.

In step 285, controller 120 may be executing in predictive mode. Controller 120 may locate in memory 122, or other storage means, last known accurate sensor data. Last known accurate sensor data may be consistent, non-anomalous, and not from a position in a predefined suspect sensor data zone.

In step 290, controller 120 may be executing in predictive mode. Controller 120 may locate in memory 122, or other storage means, last calculated position, velocity, and acceleration. Last calculated position, velocity, and acceleration may be calculated in either actual or predictive mode.

In step 295, controller 120 may be operating in predictive mode and may calculate the position based on last known accurate sensor data from step 285, last calculated position from step 290, and input from operator input device 116. In one exemplary embodiment, the position, velocity, and acceleration may be calculated using the last known sensor data, adjusting the last known sensor data based on inputs from operator input device 116 to create current estimations of the sensor data, and reporting, or calculating and reporting, the position, velocity, and acceleration of linkage 104 and work implement 106. In an alternate exemplary embodiment, the velocity and acceleration may be calculated from last known accurate sensor data adjusted for inputs from operator input device 116 for hydraulic pressure in actuator 108*a-c* cylinders, rate of change of pressure or extension of actuator 108*a-c* cylinders, or other measurements known in the art that may allow the calculation of velocity and acceleration of linkage 104 and work implement 106. In an alternate exemplary embodiment, linkage 104 and work implement 106 may have GPS type receivers, and the last known accurate sensor data may include the positional data generated by the GPS type receivers. The positional data may be adjusted based on the inputs from operator input device 116, which may be used to calculate the position, velocity, and acceleration, or may be used to confirm or refine calculations performed by controller 120. In an exemplary embodiment, a GPS type receiver may be used as a reference when installed on machine 100 stationary to the frame of reference of machine 100. In one exemplary embodiment, the reference GPS receiver may be installed next to controller 120, and in another exemplary embodiment, the reference GPS receiver may be anywhere on frame 102 that is stationary relative to the body of machine 100. In most exemplary embodiments, the position, velocity, and acceleration of linkage 104 and work implement 106 may be stored in memory 122, registers, or some other means known in the art to preserve data for later use.

In step 300, the position in step 295, and its associated velocity and acceleration may be reported. In addition, controller 120 may report it was in predictive mode. In one exemplary embodiment, the report may be displayed to the operator, and in other alternative exemplary embodiments, the report may be sent to other parts of controller 120 or other processors. In further exemplary embodiments, the report may also be stored in memory 122, registers, or some other means known in the art to preserve data for later use. After step 300 is completed, controller 120 may next execute step 230.

The flow chart of FIG. 3 illustrates various steps that typically may be involved in systems and methods in accordance with exemplary embodiments of the disclosure. It should be noted that, of the various items set forth in FIG. 3, all may not necessarily be present in a given embodiment. For example, the disclosure contemplates systems and methods with fewer than the included number of items. In addition, the sequence of the various indicated items may vary, depending, for example, on the particular type of machine 100 employed, the type of sensors 118*a-c* used, the interfaces with other components of machine 100, etc.

INDUSTRIAL APPLICABILITY

The disclosed linkage control system may be applicable to any machine 100 that includes actuators 108*a-c* where an ability to command through a soft fault and operate in the full range of motion of linkage 104 and work implement 106 is desired. The disclosed linkage control system may improve operator control by switching to a predictive mode when detecting anomalous sensor data and/or linkage 104 position enters a predefined suspect sensor data zone. Further, the disclosed linkage control system may provide flexibility by allowing the change of the relationship between actuators 108*a-c* loading and operator input device 116 depending on the type of linkage 104, actuators 108*a-c*, and work implement 106 deployed. Likewise, the linkage control system may be responsive to the types of sensor data it may be receiving. This improved flexibility may facilitate an increase in production and efficiency of machine 100. The operation of linkage control system will now be explained.

During operation of machine 100, sensor data from linkage 104, work implement 106, and actuators 108*a-c* may be sent by sensors 118*a-c* to controller 120. Controller 120 may use the sensor data to calculate the position, velocity, and acceleration of linkage 104 and work implement 106. The position, velocity, and acceleration may be used in the remote or automated control of machine 100. If anomalous sensor data or the position of linkage 104 and work implement 106 enters a predefined suspect sensor data zone, controller 120 may enter a predictive mode. In predictive mode, controller 120 may predict the position, velocity, and acceleration of linkage 104 and work implement 106 based on the last known accurate position, velocity, and acceleration, previously predicted positions, velocities, and accelerations, and inputs from operator input device 116. Predictive mode not only predicts the position of linkage 104 and work implement 106, but may also allow the operator to continue to control linkage 104 and work implement 106 and to continue to perform tasks with linkage 104 and work implement 106. This is true even when the operator may be remotely located from the machine 100 and may not be able to actually observe the position of linkage 104 and work implement 106. Combining predictive mode with automated control of machine 100 is also contemplated. The prediction of position, velocity, and acceleration may enable more accurate control of linkage 104 and work implement 106 in the performance of tasks, for example, digging, plowing, drilling, or cutting.

Controller 120 may be configured to enter a predictive mode when in a predefined suspect sensor data zone or when anomalous sensor data is detected. The predictive mode continues to provide a reliable position, velocity, and acceleration of linkage 104 and work implement 106 even though sensors 118*a-c* are not accurately reporting back to controller 120. The full range of motion of linkage 104 and work implement 106 can be exploited, even in the event of a soft fault on the wire harness.

It will be apparent to those skilled in the art that various modifications and variations can be made to the disclosed linkage control system. Other embodiments will be apparent to those skilled in the art from consideration of the specification and practice of the disclosed linkage control system. It is intended that the specification and examples be considered as exemplary only, with a true scope being indicated by the following claims and their equivalents.

What is claimed is:

1. A method of operating a machine having a linkage and a work implement, the method comprising:

tracking the position of the linkage and the work implement;

detecting sensor data for anomalous sensor data;

upon detection of anomalous sensor data, entering a predictive mode to predict the position of the linkage and work implement based on a last known accurate position, a last known accurate sensor data, and a signal from an operator input device; and detecting when the sensor data is accurate, and calculating the position of the linkage and work implement based on the accurate sensor data.

2. The method of claim 1, further including monitoring the sensor data to detect when the linkage and work implement enter or are in a predefined suspect sensor data zone.

3. The method of claim 2, further including initiating the predictive mode when the linkage and work implement enter or are in the predefined suspect sensor data zone.

4. The method of claim 1, wherein the sensor data include a velocity and acceleration of the linkage.

5. The method of claim 1, further including calculating the velocity and acceleration of the linkage and work implement from the sensor data.

6. The method of claim 1, including accessing at least one table having a predefined suspect sensor data zone in a memory.

7. The method of claim 1, further including measuring a hydraulic fluid pressure of hydraulic cylinders used to control the linkage and work implement with the at least one sensor.

8. The method of claim 1, wherein tracking the position of the linkage and work implement includes tracking the position of a boom, a stick, and a bucket.

9. The method of claim 1, further including determining that the detected sensor data is anomalous sensor data by comparing previous sensor data with new sensor data.

10. The method of claim 1, further including operating the linkage and work implement using the operator input device to perform tasks during the predictive mode.

11. The method of claim 10, further including monitoring the sensor data to detect when the linkage and work implement enter or are in a predefined suspect sensor data zone.

12. The method of claim 1, wherein detection of anomalous sensor data includes data received during a soft fault of a wire harness.

13. A method of operating a machine having a linkage and a work implement, the method comprising:

tracking the position of the linkage and the work implement;

detecting sensor data for anomalous sensor data; and upon detection of anomalous sensor data, entering a predictive mode to predict the position of the linkage and work implement based on a last known accurate position, a last known accurate sensor data, and a signal from an operator input device.

14. The method of claim 13, further including returning to an actual mode from the predictive mode when the sensor data is not anomalous.

15. The method of claim 14, further including operating the linkage and work implement using the operator input device to perform tasks during predictive mode.

16. The method of claim 13, further including monitoring the sensor data to detect when the linkage and work implement enter or are in a predefined suspect sensor data zone.

17. The method of claim 16, further including initiating the predictive mode when the linkage and work implement enter or are in the predefined suspect sensor data zone.

18. The method of claim 13, further including determining that the detected sensor data is anomalous sensor data by comparing previous sensor data with new sensor data.

19. A method of operating a machine during a soft fault of a wire harness, the machine having a linkage and a work implement, the method comprising:

tracking the position of the linkage and the work implement;

detecting sensor data for anomalous sensor data resulting from the soft fault of the wire harness;

upon detection of anomalous sensor data, entering a predictive mode to predict the position of the linkage and work implement based on a last known accurate position, a last known accurate sensor data, and a signal from an operator input device; and detecting when the sensor data is accurate, and calculating the position of the linkage and work implement based on the accurate sensor data.

20. The method of claim 19, further including determining that the detected sensor data is anomalous sensor data by comparing previous sensor data with new sensor data.

* * * * *